US011197527B2

(12) United States Patent
Chan et al.

(10) Patent No.: US 11,197,527 B2
(45) Date of Patent: Dec. 14, 2021

(54) WAX STRIP

(71) Applicant: Harry's, Inc., New York, NY (US)

(72) Inventors: Natalie Chan, Brooklyn, NY (US); Whitney Schumacher, Brooklyn, NY (US)

(73) Assignee: Harry's, Inc., New York, NY (US)

( * ) Notice: Subject to any disclaimer, the term of this patent is extended or adjusted under 35 U.S.C. 154(b) by 83 days.

(21) Appl. No.: 16/718,887

(22) Filed: Dec. 18, 2019

(65) Prior Publication Data

US 2021/0186174 A1 Jun. 24, 2021

(51) Int. Cl.
*A45D 26/00* (2006.01)

(52) U.S. Cl.
CPC ..... *A45D 26/0019* (2013.01); *A45D 26/0014* (2013.01); *A45D 2200/1036* (2013.01)

(58) Field of Classification Search
CPC ..... A45D 2200/1036; A45D 26/00; A45D 26/0014; A45D 26/0019; A45D 2026/008; A45D 2026/009; A61K 8/0208; A61K 8/92; A61K 8/922; A61K 8/925; A61K 8/927; A61Q 9/00; A61Q 9/04
See application file for complete search history.

(56) References Cited

U.S. PATENT DOCUMENTS

| | | | | |
|---|---|---|---|---|
| 2005/0070963 | A1* | 3/2005 | Wilson | A45D 26/0019 607/5 |
| 2013/0042419 | A1 | 2/2013 | Smith et al. | |
| 2013/0204274 | A1 | 8/2013 | Campbell et al. | |
| 2016/0120288 | A1* | 5/2016 | Keren | A45D 26/0019 606/134 |
| 2017/0208916 | A1 | 7/2017 | Djadar et al. | |

FOREIGN PATENT DOCUMENTS

| | | | | |
|---|---|---|---|---|
| EP | 2559422 | A1 | 2/2013 | |
| WO | 2012020245 | A1 | 2/2012 | |
| WO | WO-2017100606 | A1 * | 6/2017 | A45D 19/012 |

OTHER PUBLICATIONS

Parissa Brow Shaper Mini Wax Strips (http://www.dowantmakeup.ca), May 14, 2013 (Year: 2013).*

* cited by examiner

*Primary Examiner* — Robert A Lynch
(74) *Attorney, Agent, or Firm* — Florek & Endres PLLC

(57) ABSTRACT

A wax strip including a substantially flat, pliable backing substrate having a dimension from a first end to a second end, and a depilatory adhesive composition affixed to a portion of a first side of the backing substrate, where the depilatory adhesive composition is positioned not closer than about one-third of a distance from the first end to the second end of the dimension.

9 Claims, 3 Drawing Sheets

WAX STRIP

FIELD OF THE INVENTION

The present invention relates to the field of personal care products and more particularly to wax strips for depilation or epilation.

BACKGROUND OF THE INVENTION

Hair removal has taken on many forms over the years. Generally, these have included shaving, physical removal at the roots, electrical methods such as electrolysis, chemical treatments, etc. While each have benefits and drawbacks, it is commonly believed that physical removal at the roots provides good results for both removal of hair and extended periods between treatments, which can be performed on oneself at home.

Physical removal at the roots can be performed by various methods. For example, tweezers have been used to pull out a hair or two at a time. There are also electrical devices that grip and pull out hair as the device is passed over the user's skin. However, one of the most widely used methods is "waxing," which includes use of an adhesive composition, often having a wax component, that is applied to the skin, thereby adhering to the hair on the skin, which is quickly pulled off to remove the hair down to the roots.

Waxing has for many years been performed by the user applying a hot wax composition to an area of skin, covering the wax with a backing substrate and allowing the wax to cool, and then quickly pulling off the substrate, and wax, to remove the hair. More recent methods of waxing use a cold depilation wax composition previously applied to a strip of a backing substrate, often with a release sheet covering the portion of the wax opposite the substrate that is to be applied to the skin before use. Use of these wax strips require that the user remove the release sheet to reveal the depilation wax, firmly press the exposed wax against the skin from which the hair is to be removed and quickly pull the backing substrate, and wax, from the skin to remove the hair.

With respect to the waxing techniques described herein, including the use of wax strips described above, the term "wax" is understood to include any suitable adhesive composition or medium for securely holding hair for physical removal, and may be used interchangeably with "adhesive composition" herein It has be found, however, that known wax strips, an example of which is shown in FIG. 1, can be difficult to use. Difficulties can include proper placement of the wax over the area from which hair is to be removed, securely grasping the backing substrate for quickly pulling the wax from the skin, etc. To help overcome such issues, users have cut the edges of the backing substrate of wax strips, however, this has been found to cause wax being pushed out from the side of the wax strip, resulting in the capture of non-targeted hairs and unwanted residual wax left on the user's skin.

Although U.S. Patent Application Publication No. 2017/02089166 attempted to address the amount of wax to be used on a substrate, it merely modified the known ratios of wax to substrate without providing an improved wax strip. What is needed is an alternative design for a wax strip that overcomes various difficulties in use of known, conventional wax strips.

SUMMARY OF THE INVENTION

The present invention is directed to a wax strip comprising a substantially flat, pliable backing substrate having a dimension from a first end to a second end, and a depilatory adhesive composition affixed to a portion of a first side of the backing substrate, where the depilatory adhesive composition is positioned not closer than about one-third of a distance from the first end to the second end of the dimension. Preferably, the depilatory adhesive composition is positioned not closer than about one-half the distance from the first end to the second end of the dimension.

The dimension of the backing substrate is preferably the length or the width of the backing substrate. Therefore, the distance from a first end to a second end of the dimension can be from a first end of the length to a second end of a length or a first end of a width to a second end of a width of the backing substrate material.

The defined placement of the depilatory adhesive composition on the backing substrate provides that the depilatory adhesive composition will not cover greater than two-thirds, and preferably not greater than one-half, of a first side of the backing substrate. Of course, the depilatory adhesive composition placed on the backing substrate can take any shape, from a square to a rectangle to a circle or oval, or other shape determined to provide depilatory use for a particular environment. For example, and without limitation, U.S. Patent Application Publication No. 2012/0197268 describes a substrate having a wax shape designed for eyebrow waxing, which could be used in the present invention.

Perhaps more importantly, the wax strip of the present invention places the depilatory adhesive composition close to one end of the backing substrate. This creates a synergistic effect, facilitating the capture of targeted hairs without capturing non-targeted hairs while providing a grip portion which is at least one-third, and preferably one-half or more, of the dimension of the backing substrate. The grip portion can have other features to improve grip, however, should be devoid of depilatory adhesive. The synergistic features deliver more controlled and definitive removal of the wax strip from the skin, allowing the user to more carefully determine the area from which hair is to be removed and improving removal.

The wax strip of the present invention can be made according to any suitable method know in the art, and does not require any unique or novel method for manufacture, other than the described placement of the adhesive composition on the backing substrate.

The flat, pliable backing substrate can be made from any suitable material to which the adhesive composition can be reliably adhered for the physical removal of hair during waxing. For example, and without limitation, the substrate can be a wet laid, nonwoven material manufactured from a blend of cellulosic and polyethylene terephthalate (PET) fibers bonded with a latex binder and polyethylene (PE) coating, such as found in Grade SD9125050 Depilation Fabric sold by Ahlstrom Munksjö of Ställdalen, Sweden. Alternatively, the backing substrate can be made of any other suitable material.

Similarly, the wax strip can utilize any suitable depilatory adhesive composition, including virtually any adhesive depilatory composition known in the art. Preferably, a cold wax composition made with Resiester Gum A-35, dehydrated castor oil, Abwax white beeswax pearls/kahlwax 8104/permulgin 1550, and Tinogard TT, or similar composition, preferably including a depilating agent, antioxidant, skin conditioning agent, and binder/emulsion stabilizer, can be used for the depilatory adhesive composition.

Known features commonly used with wax strips can also be used with the wax strip of the present invention. These include, but are not limited to, a release layer covering the adhesive composition that protects the adhesive composition during shipping and storage, printed indicia on the backing substrate, release layer, and/or adhesive composition to identify the product or provide instructions for use, the ornamental placement or shape of the adhesive composition with respect to the backing substrate, the ornamental shape of one or more of the edges or areas of the backing substrate, etc., as well as variations.

BRIEF DESCRIPTION OF THE DRAWINGS

The present invention will be better understood when considered in view of the attached drawings, in which like reference characters indicate like parts. The drawings, however, are presented merely to illustrate the preferred embodiments of the invention without limiting the invention in any manner whatsoever.

DETAILED DESCRIPTION OF THE PREFERRED EMBODIMENTS

Figure 1:
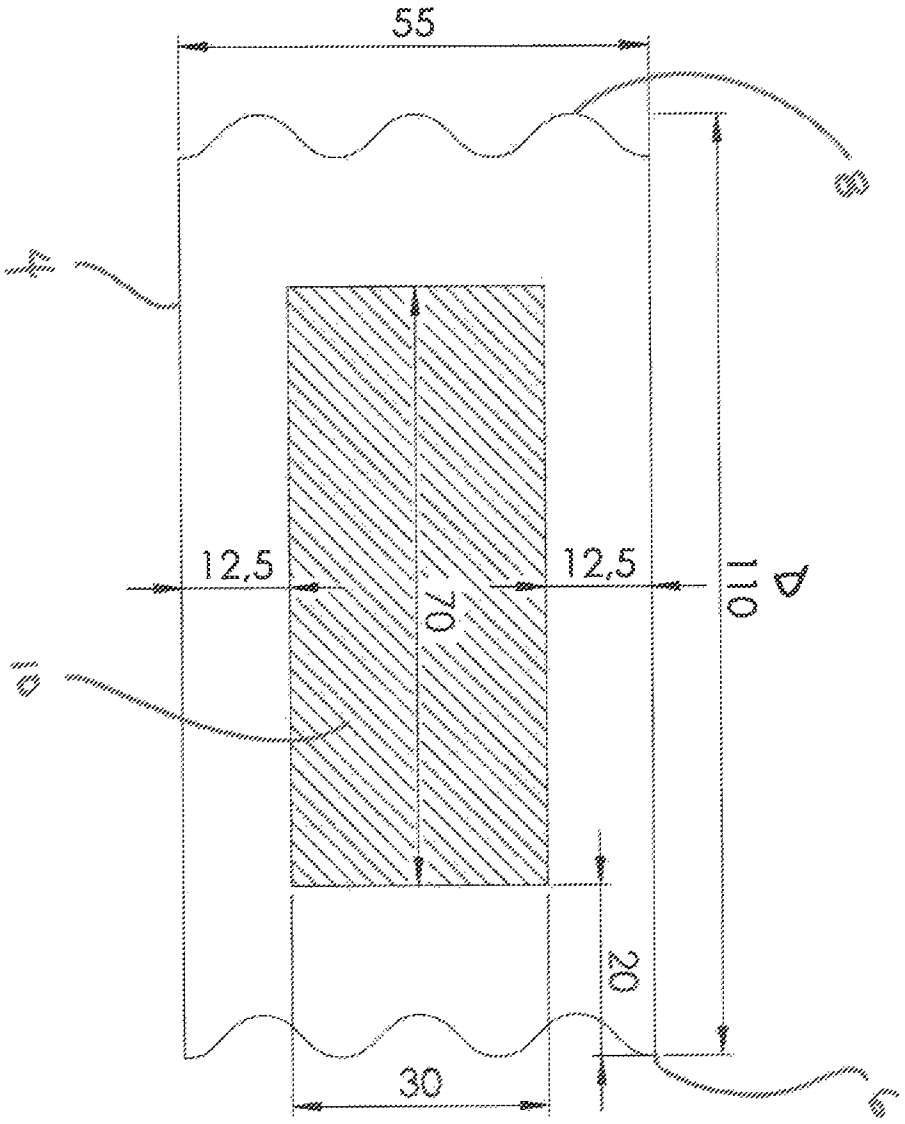
FIG. 1 (prior art)
FIG. 1 is a plan view of a wax strip for depilation as known in the prior art.
Figure 2:
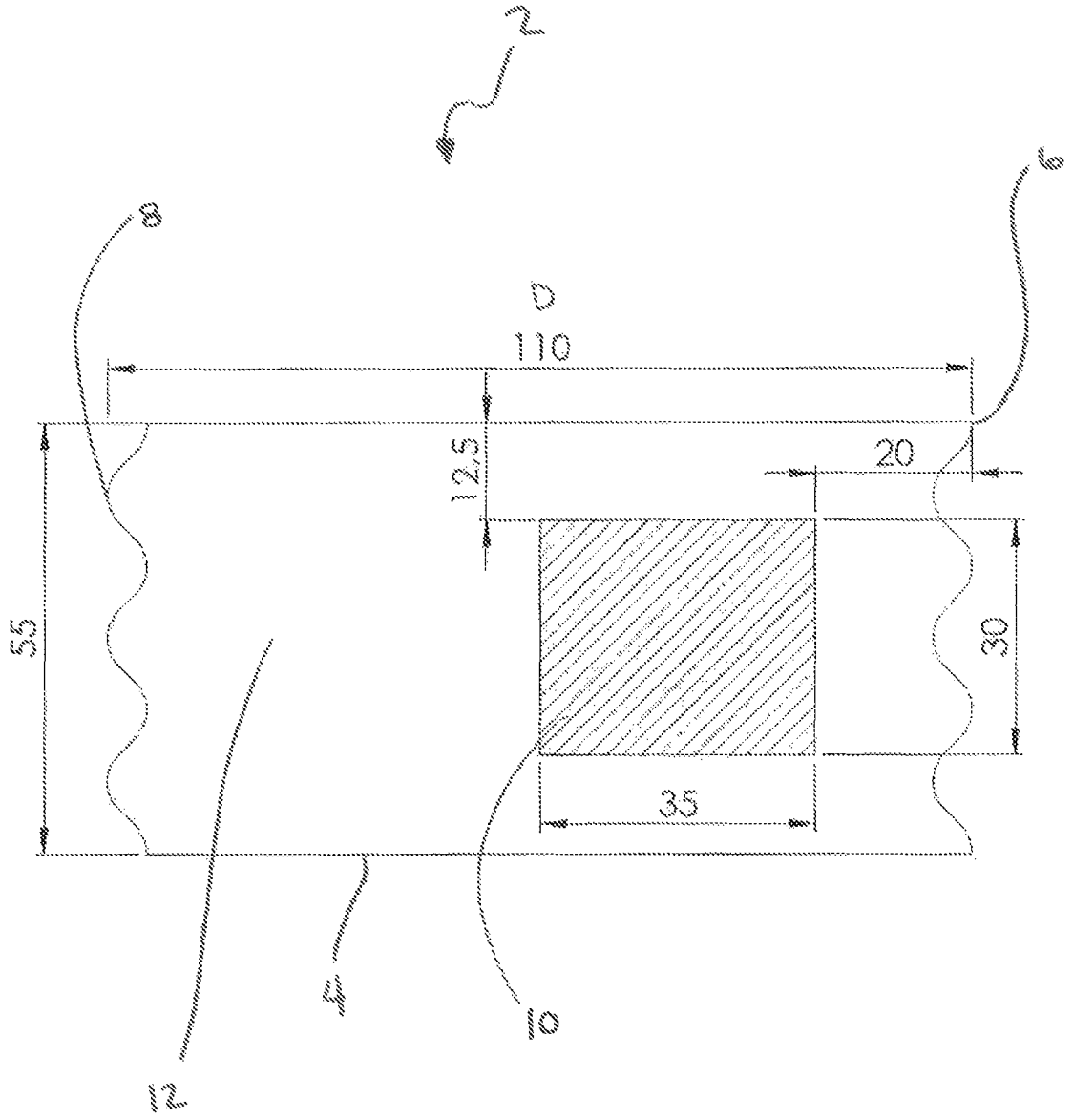
FIG. 2 is a plan view of an embodiment of a preferred wax strip of the present invention.
Figure 3:
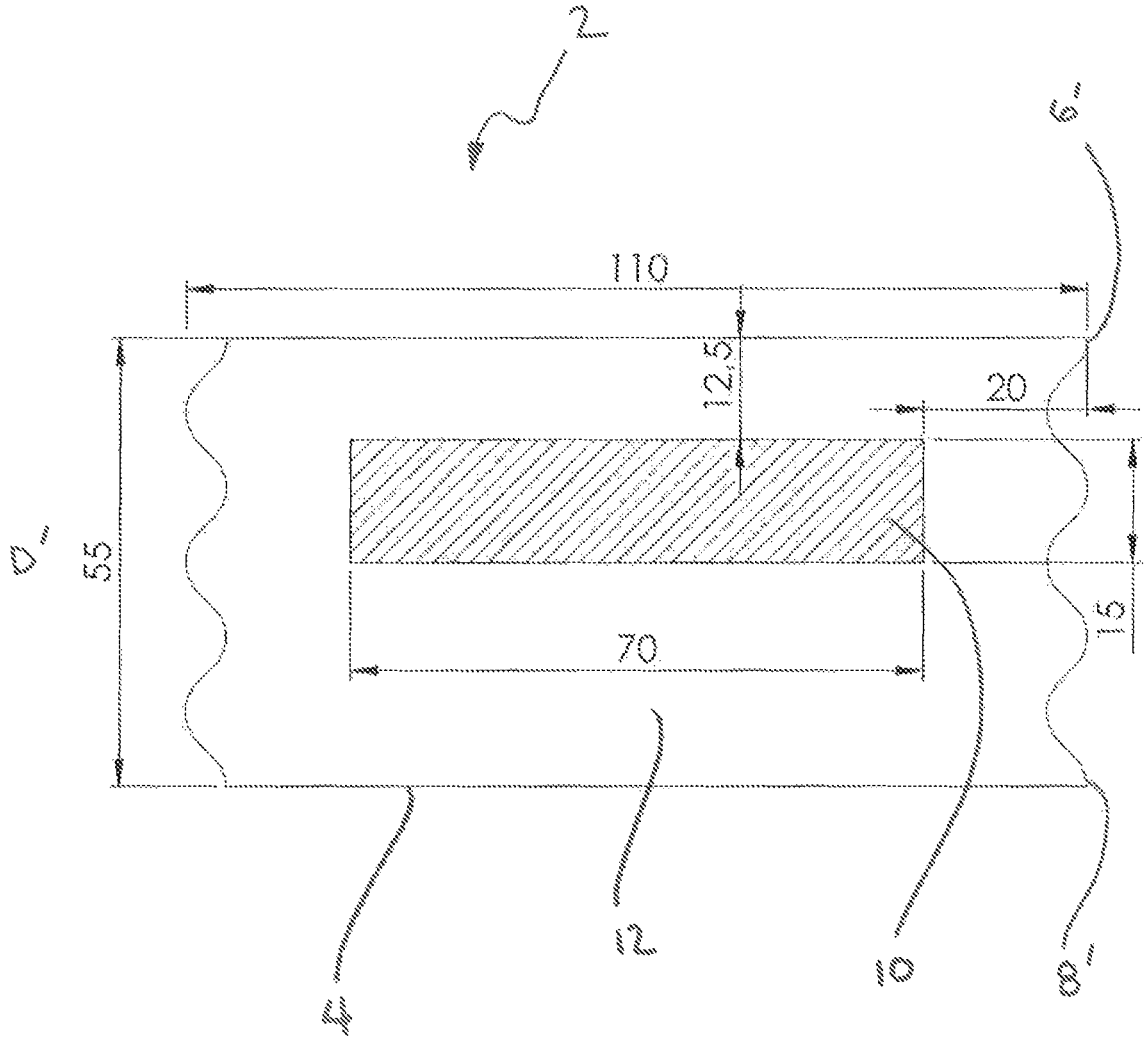
FIG. 3 is a plan view of an alternative embodiment of a preferred wax strip of the present invention.

As shown in FIGS. 2-3 the wax strip 2 of the present invention comprises a substantially flat, pliable backing substrate 4 having a dimension D from a first end 6 to a second end 8, and a depilatory adhesive composition 10 affixed to a portion of a first side of the backing substrate 4. The depilatory adhesive composition 10 is positioned not closer than about one-third of distance from the first end 6 to the second end 8 of the dimension D.

Preferred dimensions in millimeters (mm) are shown in the attached FIGS. 2-3, without limitation to the particular dimensions to be used for the wax strip 2 of the present invention. As such, the dimensions shown in the figures are merely illustrative to help describe the features of the invention. Moreover, the dimensions are approximate, so that minor variations are assumed, preferably within about ±5%.

A preferred embodiment is shown in FIG. 2, where the depilatory adhesive composition 10 is affixed to a backing substrate 4 with a length dimension D of 110 mm. The depilatory adhesive composition 10 is shown to have a length of 35 mm and is positioned 20 mm from a first end 6 of the backing substrate 4, such that the depilatory adhesive composition 10 is located entirely within 55 mm of the 110 mm total length of the dimension D. Accordingly, the depilatory adhesive composition 10 is positioned not closer than about one-third of distance from the first end 6 to the second end 8 of the dimension D, and more particularly not closer than about one-half of the distance in FIG. 2.

An alternative preferred embodiment is shown in FIG. 3, where the depilatory adhesive composition 10 is affixed to a backing substrate 4 with a width dimension D' of 55 mm. The depilatory adhesive composition 10 is shown to have a width of 15 mm and is positioned 12.5 mm from a first end 6' of the backing substrate 4, such that the adhesive composition 10 is located entirely within 27.5 mm of the 55 mm total width of the dimension D'. Accordingly, the depilatory adhesive composition 10 is positioned not closer than about one-third of distance from the first end 6' to the second end 8' of the dimension D', and more particularly not closer than about one-half of the distance in FIG. 2.

In other words, and for the purpose of more particularly defining the present invention, the depilatory adhesive composition 10 is positioned not closer than about 33% of distance from the first end 6 to the second end 8 of the dimension D, preferably not closer than about 38-40% of the distance, more preferably not closer than about 40-45% of the distance and most preferably not closer than about 50% of the distance, including not closer than about 55% and not closer than about 60-66%.

This configuration allows the user to more carefully control the wax strip 2 of the present invention. This includes not only permitting the depilatory adhesive composition 10 to be placed closer to a second end of the backing substrate 4, but also providing a larger grip area 12 for the user to securely grasp the backing substrate 4 for depilation. Therefore, the wax strip 2 of the present invention allows the user to perform depilation from narrowly defined areas rather than from broad, general areas.

As set forth above, any suitable manufacturing method, backing substrate material, depilatory adhesive composition, size, etc., may be used to produce the present invention, without limitation.

While certain exemplary embodiments have been described and shown in the accompanying drawings, it is to be understood that such embodiments are merely illustrative and not restrictive of the current invention, and that this invention is not restricted to the specific constructions and arrangements shown and described, since variation, modification, and/or alternatives can be recognized to those ordinarily skilled in the art. All such variations, modifications and/or alternatives are intended to fall within the scope of the present invention, limited only by the appended claims.

The term "comprising" as used in the following claims is an open-ended transitional term that is intended to include additional elements not specifically recited in the claims. It is also noted that any feature or element positively identified in this document may also be specifically excluded as a feature or element of an embodiment of the present invention. Any and all patents and/or patent applications referred to herein are hereby incorporated by reference.

The invention claimed is:

1. A wax strip comprising a substantially flat, pliable backing substrate having a dimension from a first end to a second end, and a depilatory adhesive composition affixed to a single location on a first side of the backing substrate, said depilatory adhesive having a width being a portion of the distance between the first end and the second end of the backing substrate, wherein the adhesive composition is positioned not closer than about 50% of a distance from the first end to the second end of the dimension, the remainder of the backing substrate being devoid of a depilatory adhesive for manual engagement by the user, wherein a distance from the depilatory adhesive to the second end is less than the width of the depilatory adhesive.

2. The wax strip of claim 1, wherein the depilatory adhesive composition is positioned not closer than about 60% of a distance from the first end to the second end of the dimension.

3. The wax strip of claim 1, wherein the depilatory adhesive composition is positioned not closer than about 66% of a distance from the first end to the second end of the dimension.

4. The wax strip of claim 1, wherein the dimension is a length dimension, measured from a most outwardly extending portion of the first end to a most outwardly extending portion of the second end.

5. The wax strip of claim 1, wherein the dimension is a width dimension, measured from a most outwardly extending portion of the first end to a most outwardly extending portion of the second end.

6. The wax strip of claim 1, wherein the wax strip further comprises a grip portion which does not comprise a depilatory adhesive composition.

7. The wax strip of claim 6, wherein the grip portion comprises not less than about 50% of a distance from the first end to the second end of the dimension.

8. The wax strip of claim 6, wherein the grip portion comprises not less than about 60% of a distance from the first end to the second end of the dimension.

9. The wax strip of claim 6, wherein the grip portion comprises not less than about 66% of a distance from the first end to the second end of the dimension.

* * * * *